US009389572B2

(12) United States Patent
Kichise

(10) Patent No.: US 9,389,572 B2
(45) Date of Patent: Jul. 12, 2016

(54) DRIVE TRANSMITTER, PROCESS UNIT INCORPORATING THE DRIVE TRANSMITTER, AND IMAGE FORMING APPARATUS INCORPORATING THE DRIVE TRANSMITTER

(71) Applicant: Mitsutoshi Kichise, Osaka (JP)

(72) Inventor: Mitsutoshi Kichise, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/741,294

(22) Filed: Jun. 16, 2015

(65) Prior Publication Data

US 2016/0004205 A1 Jan. 7, 2016

(30) Foreign Application Priority Data

Jul. 7, 2014 (JP) ..... 2014-139577

(51) Int. Cl.
*G03G 15/00* (2006.01)

(52) U.S. Cl.
CPC ..... *G03G 15/757* (2013.01)

(58) Field of Classification Search
USPC ..... 399/107, 111, 130, 159, 167, 301; 74/405, 412 R, 413, 606 R; 475/149, 475/150, 153, 269
See application file for complete search history.

(56) References Cited

U.S. PATENT DOCUMENTS 6,829,457 B2 * 12/2004 Ryuzaki ..... F16H 57/12 399/167
6,909,866 B2 * 6/2005 Kawai ..... G03G 15/757 399/167
7,194,228 B2 * 3/2007 Arimitsu ..... G03G 15/0216 399/111
7,664,436 B2 * 2/2010 Aoki ..... G03G 15/0173 399/119
7,865,115 B2 * 1/2011 Oguma ..... G03G 15/0216 399/167
8,548,369 B2 * 10/2013 Kim ..... G03G 15/6511 399/391
8,565,646 B2 * 10/2013 Suzuki ..... G03G 15/161 399/167
8,867,965 B2 * 10/2014 Suto ..... G03G 15/757 399/167
8,900,088 B2 * 12/2014 Yasuda ..... G03G 15/757 475/311
2009/0285594 A1 11/2009 Kichise et al.
2015/0117901 A1 4/2015 Kichise et al.

FOREIGN PATENT DOCUMENTS

JP 2000-249210 9/2000
JP 2010-202288 9/2010

* cited by examiner

*Primary Examiner* — Hoan Tran
(74) *Attorney, Agent, or Firm* — Harness, Dickey & Pierce, P.L.C.

(57) ABSTRACT

A drive transmitter, which is includable to a process unit and an image forming apparatus, includes a first gear, a second gear, and a rotation regulator. The first gear has at least one tooth. The second gear has multiple teeth, one of which is meshed with the at least one tooth of the first gear and rotated with the first gear. The first gear continuously rotates and the second gear remains stationary when not in mesh. The number of rotations of the second gear per unit time is smaller than the number of rotations of the first gear. The rotation regulator regulates rotation of the second gear such that a tip of the second gear meshing with the first gear is located downstream from an intersection start point in a rotation direction of the second gear and upstream from an intersection end point in the rotation direction.

23 Claims, 9 Drawing Sheets

DRIVE TRANSMITTER, PROCESS UNIT INCORPORATING THE DRIVE TRANSMITTER, AND IMAGE FORMING APPARATUS INCORPORATING THE DRIVE TRANSMITTER

CROSS-REFERENCE TO RELATED APPLICATIONS

This patent application is based on and claims priority pursuant to 35 U.S.C. §119(a) to Japanese Patent Application No. 2014-139577, filed on Jul. 7, 2014, in the Japan Patent Office, the entire disclosure of which is hereby incorporated by reference herein.

BACKGROUND

1. Technical Field

This disclosure relates to a drive transmitter to transmit a driving force to reduce a speed of rotation of a gear per unit time, a process unit incorporating the drive unit, and an image forming apparatus incorporating the drive unit.

2. Related Art

A known drive transmitter that decelerates and transmits a driving force from a drive source such as a motor includes a partially toothed gear that has a part where teeth are provided to a part of an outer diameter thereof.

For example, a drive transmitter including a partially toothed gear is employed to a device to transmit a driving force to a stirring blade in a developing device of a printer.

A tooth of multiple teeth of a driven gear mesh with a tooth of a partially toothed gear, and therefore the driven gear is rotated with the partially toothed gear. However, once the driven gear and the partially toothed gear are disengaged, the driven gear stops rotating while the partially toothed gear keeps rotating. Consequently, the driven gear rotates intermittently, and the number of rotations of the driven gear per unit time is reduced and becomes smaller than the number of rotations of the partially toothed gear per unit time. Accordingly, a decelerated driving force is transmitted to the driven gear.

SUMMARY

At least one aspect of this disclosure provides a drive transmitter including a first gear, a second gear, and a rotation regulator. The first gear has at least one tooth located on an outer circumference thereof and is rotated by a drive source. The second gear has multiple teeth located on an outer circumference thereof. One of the multiple teeth of the second gear is meshed with the at least one tooth of the first gear and is rotated with the first gear. The first gear continuously rotates and the second gear remains stationary in a state in which the first gear and the second gear are not in mesh. The first gear transmits a driving force transmitted by the drive source to the second gear in a state in which the number of rotations of the second gear per unit time is smaller than the number of rotations of the first gear. A trajectory of a tip of the at least one tooth of the first gear and a trajectory of a tip of the one of the multiple teeth of the second gear intersect with each other at an intersection start point and an intersection end point. The rotation regulator regulates rotation of the second gear such that a position of the tip of the one of the multiple teeth of the second gear meshing with the at least one tooth of the first gear is located downstream from the intersection start point in a rotation direction of the second gear and is located upstream from the intersection end point in the rotation direction of the second gear.

Further, at least one aspect of this disclosure provides a process unit including a latent image bearer, a rotator, and the drive transmitter. The latent image bearer bears a latent image on a surface thereof. The rotator conveys or stirs powder used for image formation to the latent image. The drive transmitter further includes a gear train to include the first gear and the second gear and to transmit the driving force applied from the drive source to the latent image bearer and the rotator. The first gear is disposed on a side of the latent image bearer. The second gear is disposed on a side of the rotator.

Further, at least one aspect of this disclosure provides an image forming apparatus including the drive transmitter.

DETAILED DESCRIPTION

Figure 1:
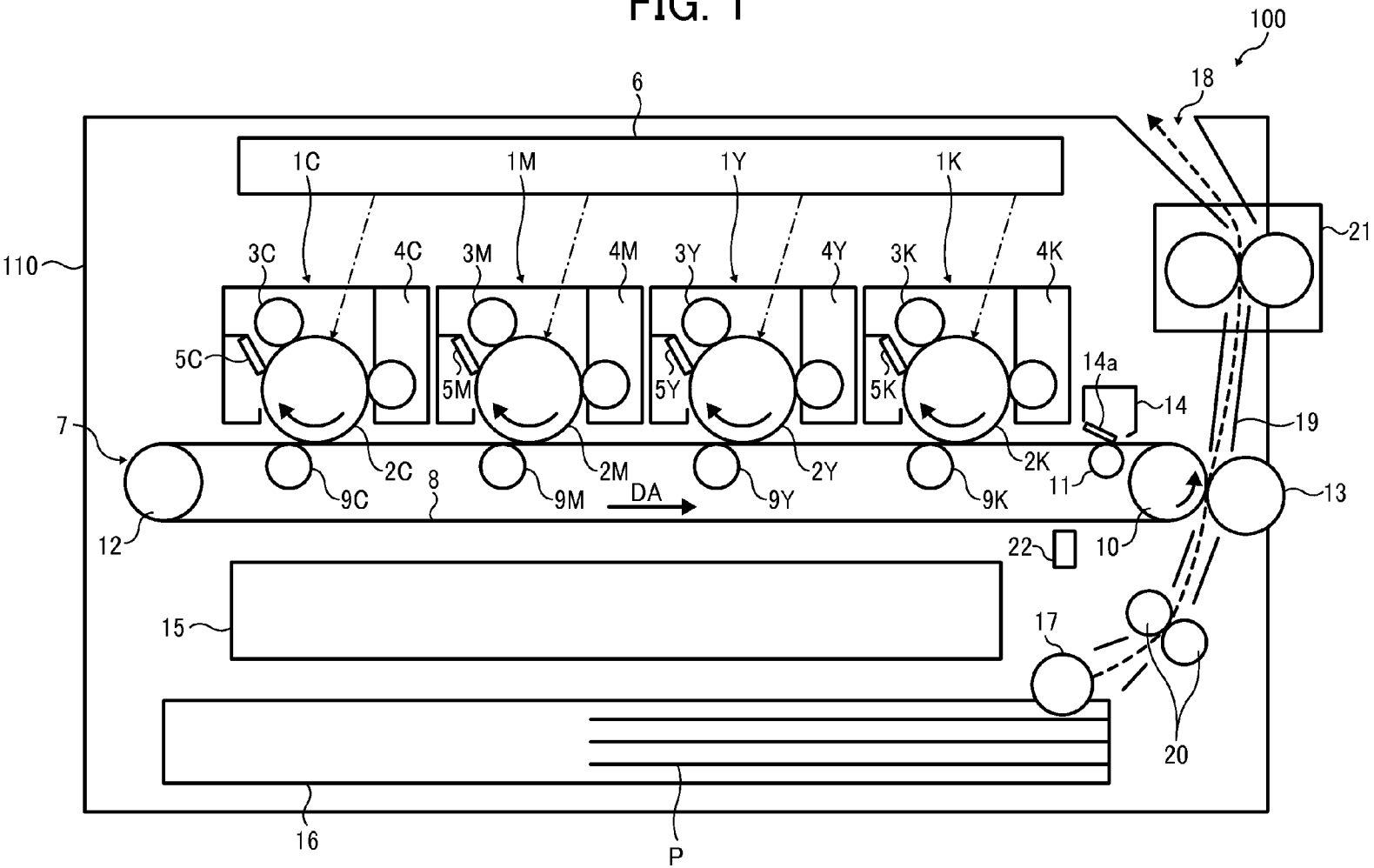
FIG. 1 is a diagram illustrating a schematic configuration of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of an image forming apparatus 100 according to an example of this disclosure with reference to drawings. FIG. 1 is a diagram illustrating a schematic configuration of the image forming apparatus 100 according to an example of this disclosure. With reference to FIG. 1, a description is given of an entire configuration and functions of the image forming apparatus 100.

The image forming apparatus 100 may be a copier, a facsimile machine, a printer, a plotter, a multifunction peripheral or a multifunction printer (MFP) having at least one of copying, printing, scanning, facsimile, and plotter functions, or the like. According to the present example, the image forming apparatus 100 is an electrophotographic printer that forms color and monochrome toner images on a sheet or sheets by electrophotography.

More specifically, the image forming apparatus 100 functions as a laser printer. However, the image forming apparatus 100 can expand its function as a copier by adding a scanner as an option disposed on top of an apparatus body of the image forming apparatus 100. The image forming apparatus 100 can further obtain functions as a facsimile machine by adding an optional facsimile substrate in the apparatus body of the image forming apparatus 100.

As illustrated in FIG. 1, the image forming apparatus 100 includes an apparatus body 110 and four process units 1K, 1Y, 1M, and 1C provided detachably attachable to the apparatus body 110 of the image forming apparatus 100. Each of the process units 1K, 1Y, 1M, and 1C functions as an image forming unit. Hereinafter, the process units 1K, 1Y, 1M, and 1C are also referred to in a singular form without any suffix, for example, the process unit 1. In addition, the singular form can also be applied to any members and units included in the image forming apparatus 100 and having identical structure and functions to each other with the same reference numeral and different suffix attached thereto.

The process unit 1 (i.e., the process units 1K, 1Y, 1M, and 1C) include a photoconductor 2 (i.e., photoconductors 2K, 2Y, 2M, and 2C), a charging roller 3 (i.e., charging rollers 3K, 3Y, 3M, and 3C), a developing device 4 (i.e., developing devices 4K, 4Y, 4M, and 4C), and a cleaning blade 5 (i.e., cleaning blades 5K, 5Y, 5M, and 5C).

The photoconductor 2 functions as a latent image bearer to form an electrostatic latent image on a surface thereof. The charging roller 3 functions as a charger to uniformly charge the surface of the photoconductor 2. The developing device 4 supplies toner as powder used for image formation onto the electrostatic latent image formed on the surface of the photoconductor 2 and develops the electrostatic latent image into a visible toner image. The cleaning blade 5 functions as a cleaner to clean the surface of the photoconductor 2.

In the present example, the photoconductor 2 is a cylindrical conductor drum.

The charging roller 3 contacts the surface of the photoconductor 2 and is rotated along with rotation of the photoconductor 2. A high-voltage power supply applies a bias of a direct current (DC) or of a DC current having a superimposed alternating current (AC) component to the charging roller 3. By so doing, the surface of the photoconductor 2 is uniformly charged.

The developing device 4 transfers the toner onto the electrostatic latent image formed on the surface of the photoconductor 2 due to a given developing bias supplied from a high-voltage power supply. By so doing, the toner image (formed by supplying developer) is developed.

The cleaning blade 5 is disposed in contact with the surface of the photoconductor 2 in a counter direction in which a leading edge of the cleaning blade 5 is oriented in an opposite direction of rotation of the photoconductor 2. By so doing, residual toner or other foreign materials remaining on the surface of the photoconductor 2 is scraped and removed from the surface of the photoconductor 2 along with rotation of the photoconductor 2.

In FIG. 1, the image forming apparatus 100 further includes an optical writing device 6 that is disposed above the process units 1K, 1Y, 1M, and 1C. The optical writing device 6 functions as a latent image forming device to form an electrostatic latent image on the surface of each of the photoconductors 2K, 2Y, 2M, and 2C. The optical writing device 6 includes a light source, a polygon minor, an f-theta (f-θ) lens, and reflection mirrors, so as to emit laser light to the surface of the photoconductor 2 based on image data. Further, as the optical writing device 6, a light emitting diode (LED) head in which multiple light emitting diode elements are arranged in an array state can be employed.

Further, as illustrated in FIG. 1, the image forming apparatus 100 further includes a transfer device 7. The transfer device 7 is disposed below the process units 1K, 1Y, 1M, and 1C and includes an intermediate transfer belt 8 that functions as an intermediate transfer member.

The intermediate transfer belt 8 is wound around four primary transfer rollers 9K, 9Y, 9M, and 9C, a secondary backup roller 10, a cleaning backup roller 11, and a tension roller 12. Each of the primary transfer rollers 9K, 9Y, 9M, and 9C functions as a primary transfer member. The intermediate transfer belt 8 is rotated (moves around the rollers) together with rotation of the secondary backup roller 10.

The tension roller 12 presses the intermediate transfer belt 8 by springs provided at both axial ends thereof, so as to apply given tension to hold or support the intermediate transfer belt 8 with taut.

As an example of materials of the intermediate transfer belt 8, an endless belt formed of a resin film produced by dispersing a conductive material such as carbon black in PVDF (vinylidene fluoride), ETFE (a tetrafluoroethylene-ethylene copolymer), PI (polyimide), PC (polycarbonate), TPE (thermoplastic elastomer) and the like is generally used.

The primary transfer roller 9 (i.e., the primary transfer rollers 9K, 9Y, 9M, and 9C) is a metallic roller or a conductive sponge roller. Alternative to a roller type member, a conductive blade may also be applicable to a primary transfer member.

The primary transfer roller 9 is disposed facing the corresponding photoconductor 2 with the intermediate transfer belt 8 interposed therebetween and presses an inner circumferential surface of the intermediate transfer belt 8 at a given position. A primary transfer nip is formed at a region where the pressed part of the intermediate transfer belt 8 and the photoconductor 2 contact. A given primary transfer bias is applied from a single high-voltage power supply to the primary transfer roller 9. This application of the primary transfer bias to the primary transfer roller 9 generates an electric field in the primary transfer nip to perform primary transfer of a toner image in the primary transfer nip.

A secondary transfer roller 13 is disposed at a position opposite to the secondary backup roller 10 via the intermediate transfer belt 8. The secondary transfer roller 13 that functions as a secondary transfer member is a sponge roller such as an ion conductive roller and an electronically conductive roller.

The secondary transfer roller 13 presses an outer circumferential surface of the intermediate transfer belt 8. A secondary transfer nip is formed at a region where the pressed part of the intermediate transfer belt 8 and the secondary transfer roller 13 contact. Further, the secondary transfer roller 13 is connected to a high-voltage power supply, so that a given secondary transfer bias is applied from the high-voltage power supply to the secondary transfer roller 13. This application of the secondary transfer bias to the secondary transfer roller 13 generates an electric field in the secondary transfer nip to perform secondary transfer of the toner image in the secondary transfer nip.

The image forming apparatus 100 further includes a toner mark sensor 22, a belt cleaning device 14, and a waste toner collecting part 15.

The toner mark sensor 22 is a specular reflection type sensor or a diffused reflection type sensor. The toner mark sensor 22 measures a toner image density or a position of each image on the intermediate transfer belt 8 and adjusts image density and performs positioning of the toner image.

The belt cleaning device 14 cleans a surface of the intermediate transfer belt 8. The belt cleaning device 14 includes a cleaning blade 14*a*. The belt cleaning blade 14*a* is supported by the cleaning backup roller 11 and is disposed in contact with the surface of the intermediate transfer belt 8 in a counter direction in which a leading edge of the belt cleaning blade 14*a* is oriented in an opposite direction of rotation of the intermediate transfer belt 8. By so doing, residual toner or other foreign materials remaining on the surface of the intermediate transfer belt 8 is scraped and removed by the cleaning blade 14*a* from the surface of the intermediate transfer belt 8 along with rotation of the intermediate transfer belt 8.

The waste toner collecting part 15 is disposed below the transfer device 7. The waste toner collecting part 15 collects waste toner removed by the belt cleaning device 14.

The image forming apparatus 100 further includes a sheet tray 16, a feed roller 17, a sheet ejection part 18, a sheet conveying path 19, a registration roller pair 20, and a fixing device 21.

The sheet tray 16 that accommodates a sheet P functioning as a recording medium and the feed roller 17 that feeds the sheet P from the sheet tray 16.

It is to be noted in the following examples that the term "sheet" is not limited to indicate a paper material such as a plain paper but also includes OHP (overhead projector) transparencies, OHP film sheets, coated sheet, art sheet, tracing paper, thin paper, thick paper such as post card, envelope, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

The sheet ejection part 18 is disposed at an upper part of the apparatus body 110 to eject the sheet P therefrom. The sheet conveying path 19 is provided from the sheet tray 16 to the sheet ejection part 18 via the secondary transfer nip to convey the sheet P therethrough in the apparatus body 110.

The registration roller pair 20 is disposed upstream from the secondary transfer roller 13 in a sheet conveying direction in the sheet conveying path 19. The registration roller pair 20 functions as a timing roller to adjust the timing of conveying the sheet P to the secondary transfer nip.

The fixing device 21 is disposed downstream from the secondary transfer roller 13 in the sheet conveying direction in the sheet conveying path 19. An unfixed toner image formed on the sheet P is fixed to the sheet P in the fixing device 21.

Now, a description is given of operations performed in the image forming apparatus 100.

As an image forming operation starts, a drive unit drives the photoconductor 2 (i.e., the photoconductors 2K, 2Y, 2M, and 2C) of the process unit 1 (i.e., the process units 1K, 1Y, 1M, and 1C) to rotate clockwise in FIG. 1, so that the charging roller 3 uniformly charges the surface of the photoconductor 2 to a given polarity. Based on image data transmitted from a reading device or an external computer, the optical writing device 6 emits laser light to irradiate the charged surface of the photoconductor 2 so as to form an electrostatic latent image on the surface of the photoconductor 2. At this time, the image data to be exposed to the surface of the photoconductor 2 is image data for each of single colors obtained by color separation of a full color image of black, yellow, magenta, and cyan. Then, the developing device 4 supplies toner to the electrostatic latent image formed on the surface of the photoconductor 2. By so doing, the electrostatic latent image is developed and visualized into a visible toner image.

Further, as the image forming operation starts, the secondary backup roller 10 that holds the intermediate transfer belt 8 with taut rotates counterclockwise in FIG. 1, so that the intermediate transfer belt 8 rotates in a direction indicated by arrow DA in FIG. 1. Further, by applying a primary transfer bias having an opposite polarity to a toner charging polarity to the primary transfer roller 9 (i.e., the primary transfer rollers 9K, 9Y, 9M, and 9C), the electric field is generated in the primary transfer nip.

Thereafter, as the photoconductors 2K, 2Y, 2M, and 2C rotate, the respective toner images formed on the surfaces of the photoconductors 2K, 2Y, 2M, and 2C reach the corresponding primary transfer nips. At this time, the electric field of the respective primary transfer nips causes the respective toner images formed on the surfaces of the photoconductors 2K, 2Y, 2M, and 2C to be sequentially transferred onto the surface of the intermediate transfer belt 8. The respective toner images formed on the surfaces of the photoconductors 2K, 2Y, 2M, and 2C are overlaid to form a full color toner image on the surface of the intermediate transfer belt 8.

Residual toner remaining on the surfaces of the photoconductors 2K, 2Y, 2M, and 2C is removed therefrom by the cleaning blade 5.

In the lower part of the image forming apparatus 100, the feed roller 17 starts to rotate to feed the sheet P from the sheet tray 16 into the sheet conveying path 19. The sheet P fed to the sheet conveying path 19 is conveyed to the secondary transfer nip at the timing adjusted by the registration roller pair 20. At this time, the secondary transfer roller 13 is applied with a transfer bias having an opposite polarity to the toner charging polarity of the toner image formed on the surface of the intermediate transfer belt 8. By so doing, the electric field is generated in the primary transfer nip.

It is to be noted that the above-described high voltage power supplies may be separate power supplies or a common power supply.

Thereafter, as the intermediate transfer belt 8 rotates, the full color toner image formed on the surfaces of the intermediate transfer belt 8 reaches the secondary transfer nips. At this time, the electric field of the secondary primary transfer nip causes the full color toner image formed on the surfaces of the intermediate transfer belt 8 to be transferred onto the sheet P.

Residual toner remaining on the surface of the intermediate transfer belt 8 is removed therefrom by the belt cleaning device 14, and then collected and conveyed to the waste toner collecting part 15.

The sheet P having the toner image thereon is separated from the intermediate transfer belt 8 due to curvature of the secondary backup roller 10, and then is conveyed to the fixing device 21. In the fixing device 21, the toner image formed on the sheet P is fixed to the sheet P. Thereafter, the sheet P is ejected to the outside of the image forming apparatus 100 through the sheet ejection part 18.

The above-described operations are performed when a full-color image is formed on the sheet P. Other than the above-described operations, any one of the process units 1K, 1Y, 1M, and 1C can selectively be used for forming a single color image or any two or three of the process units 1K, 1Y, 1M, and 1C can be used for forming a composite image of two or three colors.

Now, a description is given of a drive transmitter 150 included in the process unit 1.

Figure 2:
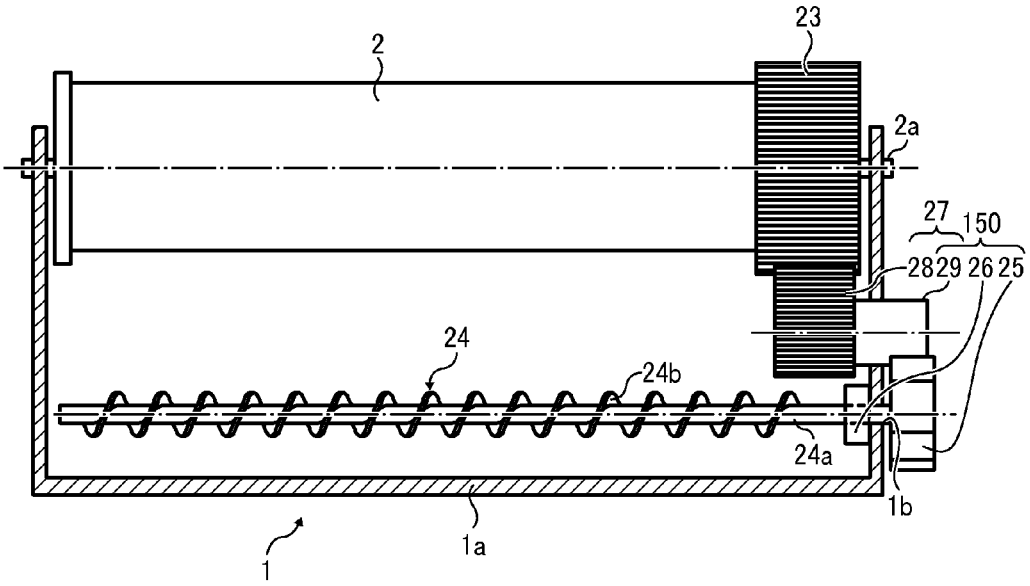
FIG. 2 is a diagram illustrating a schematic configuration of a process unit included in the image forming apparatus of FIG. 1 and a drive transmitter provided to the process unit.

FIG. 2 is a diagram illustrating a schematic configuration of the process unit 1 included in the image forming apparatus 100 of FIG. 1 and the drive transmitter 150 provided to the process unit 1.

It is to be noted that, since the process units 1K, 1Y, 1M, and 1C have identical structures to each other except for the colors of toners, the following structure and operations are explained with a single process unit 1 (without suffixes K, Y, M, and C) in order to simplify the description. Any of the process units 1K, 1Y, 1M, and 1C can be applied to the single process unit 1.

As illustrated in FIG. 2, a rotary shaft 2*a* of the photoconductor 2 is rotatably supported by a housing 1*a* of the process unit 1. A photoconductor gear 23 is attached by press-fitting to one axial end of the photoconductor 2. The photoconductor gear 23 has a flange shape and transmits a rotational driving force to the photoconductor 2.

A conveying screw 24 is rotatably supported by the housing 1*a* of the process unit 1. The conveying screw 24 includes a rotary shaft 24*a* and a helical blade 24*b*. The conveying screw 24 is a conveying member or a conveyor to convey waste toner that is removed by the cleaning blade 5 from the surface of the photoconductor 2 to the waste toner collecting part 15. A conveying gear 25 is mounted on one axial end of the rotary shaft 24*a* of the conveying screw 24. The conveying gear 25 transmits a rotational driving force to the conveying screw 24.

A seal 26 is attached to the same axial end of the rotary shaft 24*a* of the conveying screw 24. The seal 26 blocks and prevents toner from coming in between the rotary shaft 24*a* of the conveying screw 24 and a bearing 1*b* of the housing 1*a* that supports the conveying screw 24.

The seal 26 includes an elastic member such as a urethane foam. For example, the urethane foam having the apparent density of 58 kg/m$^3$ or greater can be employed as the seal 26 to achieve a reduction in cost of producing a seal that is highly effective to prevent toner leakage.

It is to be noted that the "apparent density" is a value measured in conformity to JIS K 7222 (Japanese Industrial Standards).

The photoconductor gear 23 and the conveying gear 25 are linked and connected to a connection gear 27. The connection gear 27 is rotatably supported by the housing 1*a* of the process unit 1. A driving force applied to the photoconductor gear 23 is also transmitted to the conveying gear 25 via the connection gear 27 so as to rotate the conveying screw 24. Thus, the configuration of this example can transmit a driving force generated by a single drive source to both the photoconductor 2 and the conveying screw 24. Therefore, multiple drive sources are not prepared separately for the photoconductor 2 and for the conveying screw 24. As a result, the present example of this disclosure can achieve a reduction in size and cost of the image forming apparatus 100.

As described above, in a configuration in which a common drive source drives both the photoconductor 2 and the conveying screw 24, the conveying screw 24 rotates with the photoconductor 2. However, if the conveying screw 24 rotates too fast, toner conveyed to a downstream unit is likely to be stuffed and aggregated in the downstream unit.

In order to avoid this inconvenience, the connection gear 27 is provided to the configuration of the process unit 1 according to the present example of this disclosure. Specifically, the connection gear 27 has two connecting parts having different structures from each other. One connecting part of the connection gear 27 is connected to the photoconductor gear 23 and the other connecting part thereof is connected to the conveying gear 25. The connecting part of the connection gear 27 to the conveying gear 25 is a partially toothed gear 29 that has a projection (a tooth) on a part of an outer circumference thereof. By contrast, the connecting part of the connection gear 27 to the photoconductor gear 23 is a fully toothed gear 28 that has multiple projections (teeth) over an outer circumference thereof.

As illustrated in FIG. 2, the partially toothed gear 29, the conveying gear 25, and the seal 26 form the drive transmitter 150.

Figure 3:
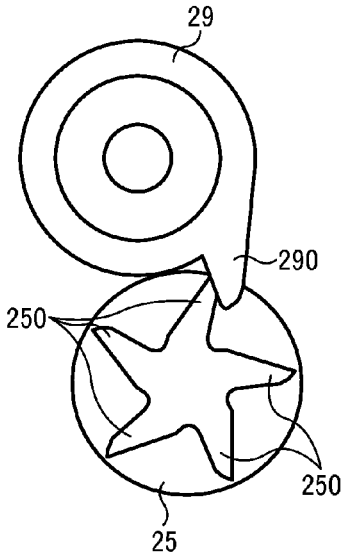
FIG. 3 is a diagram illustrating a partially toothed gear and a conveying gear, viewed from an axial direction thereof.

FIG. 3 is a diagram illustrating the partially toothed gear 29 and the conveying gear 25, viewed from an axial direction thereof.

As illustrated in FIG. 3, the partially toothed gear 29 has one projection 290 on the outer circumference thereof. By contrast, the conveying gear 25 has five projections 250 on the outer circumference thereof.

Figure 4A:
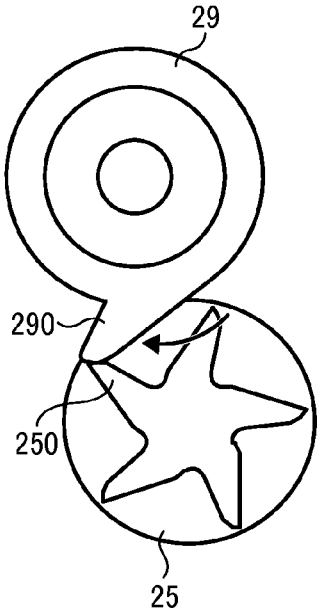
FIG. 4A is a diagram illustrating a state in which a projection of the partially toothed gear and a projection of the conveying gear are disengaged.
Figure 4B:
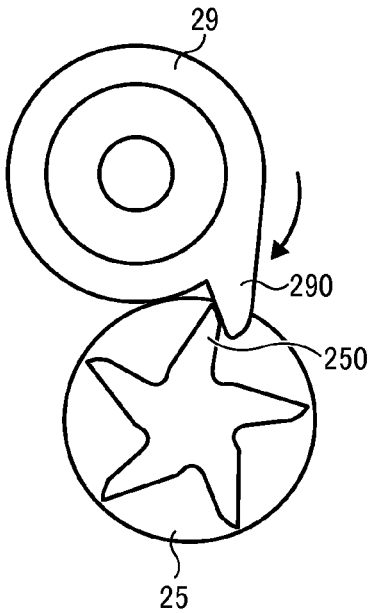
FIG. 4B is a diagram illustrating a state in which the projection of the partially toothed gear and the projection of the conveying gear are meshed again.

FIG. 4A is a diagram illustrating a state in which the projection 290 of the partially toothed gear 29 and one of the projections 250 of the conveying gear 25 are disengaged. FIG. 4B is a diagram illustrating a state in which the projection 290 of the partially toothed gear 29 and a subsequent one of the projections 250 of the conveying gear 25 are meshed again.

When the projection 290 of the partially toothed gear 29 is meshed with one of the projections of the conveying gear 25, the conveying gear 25 is rotated with the partially toothed gear 29. However, during the period from disengagement of the projections 290 and the 250 as illustrated in FIG. 4A to another engagement of the projections 290 and 250 as illustrated in FIG. 4B, the conveying gear 25 stops rotating while the partially toothed gear 29 continuously rotates. In other words, in a state in which the partially toothed gear 29 and the conveying gear 25 are not meshed, the partially toothed gear 29 continuously rotates and the conveying gear 25 remains stationary. Since the conveying gear 25 is intermittently rotated while the partially toothed gear 29 continuously rotates, the driving force generated by the drive unit is transmitted in a state in which the number of rotations of the conveying gear 25 per unit time from the partially toothed gear 29 is reduced. That is, the partially toothed gear 29 transmits the driving force to the conveying gear 25 in a state in which the number of rotations of the conveying gear 25 per unit time with respect to the partially toothed gear 29 is smaller than the number of rotations of the partially toothed gear 29.

In the present example, when the partially toothed gear 29 completes one full rotation, the conveying gear 25 is rotated by one-fifth of a turn. When the partially toothed gear 29 completes five full rotations, the conveying gear 25 completes one full rotation. Further, by changing the number of projections 290 of the partially toothed gear 29 of the number of projections 250 of the conveying gear 25, the speed of rotation of the conveying gear 25 can be set optionally.

When the partially toothed gear 29 and the conveying gear 25 are disengaged, the conveying gear 25 stops rotating due to sliding friction generated between the rotary shaft 24*a* of the conveying screw 24 and the bearing 1*b*, a load applied when the conveying screw 24 conveys the waste toner, etc. However, the load applied by waste toner varies depending on the amount of waste toner. Specifically, when there is no waste toner such as the initial state of usage of the image forming apparatus 100, no load is applied. Therefore, if the load applied by waste toner is the dominant factor to stop rotation of the conveying gear 25, in a case in which there is no waste toner, for example, in the initial state of the image forming apparatus 100, no or less load is applied to rotate the conveying screw 24. Therefore, it is likely that the conveying gear 25 does not stop at a given or regular stop position.

Figure 5A:
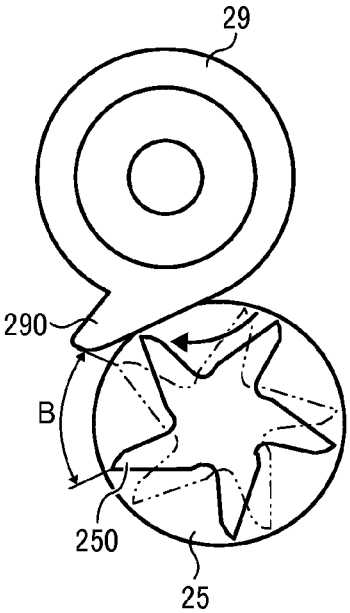
FIG. 5A is a diagram illustrating a state in which the conveying gear does not stop and is shifted from a regular stop position.
Figure 5B:
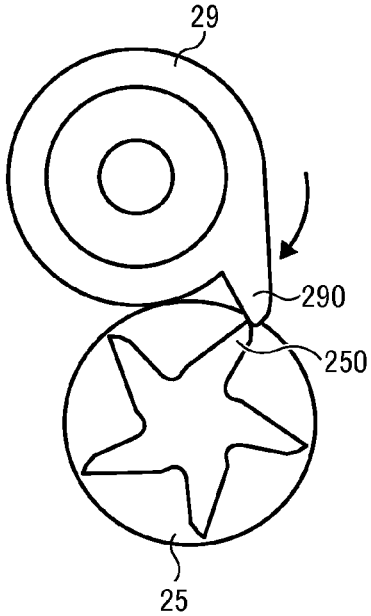
FIG. 5B is a diagram illustrating a state in which a tip of the projection of the partially toothed gear contacts a tip of the projection of the conveying gear.

FIG. 5A is a diagram illustrating a state in which the conveying gear 25 does not stop and is shifted from a regular stop position. FIG. 5B is a diagram illustrating a state in which a tip of the projection 290 of the partially toothed gear 29 contacts a tip of the projection 250 of the conveying gear 25.

As illustrated in FIG. 5A, the conveying gear 25 does not stop at the regular stop position indicated by a two-dot chain line but stops at a position shifted from the regular stop position by a distance B. Consequently, as illustrated in FIG. 5B, a tip of the projection 290 of the partially toothed gear 29 is likely to contact a tip of the projection 250 of the conveying gear 25 at a subsequent engagement. If the respective tips of the projections 290 and 250 contact to each other, this contact causes impact to be transmitted to the photoconductor 2 via the partially toothed gear 29 and the conveying gear 25. Accordingly, defect images having horizontal streaks are produced and/or image density becomes uneven. In the worst case, the respective tips of the projections 290 and 250 are damaged and broken and the conveying screw 24 cannot be driven.

For example, a drive transmitter including a partially toothed gear is employed to a device to transmit a driving force to a stirring blade in a developing device of a printer.

Figure 6:
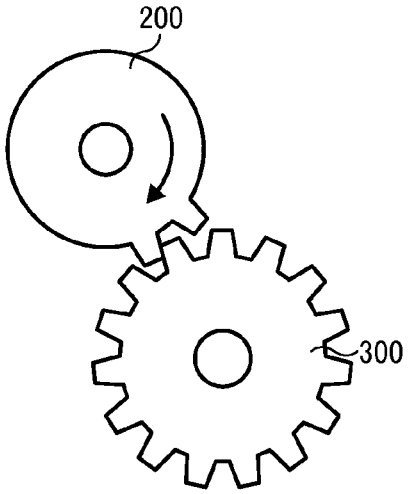
FIG. 6 is a diagram illustrating a configuration of gear meshing of a partially toothed gear and a driven gear included in a comparative drive transmitter according to a comparative example.

As illustrated in a comparative configuration of such a drive transmitter in FIG. 6, as a drive source applies a driving force, a partially toothed gear 200 rotates. Then, teeth of a driven gear 300 mesh with teeth of the partially toothed gear 200, and therefore the driven gear 300 is rotated with the partially toothed gear 200. However, once the driven gear 300 and the partially toothed gear 200 are disengaged, the driven gear 300 stops rotating while the partially toothed gear 200 keeps rotating until the next engagement thereof. By intermittently rotating the driven gear 300 while the partially toothed gear 200 continues the rotation thereof, the number of rotation of the driven gear 300 per unit time is reduced and becomes smaller than the number of rotation of the partially toothed gear 200 per unit time. Consequently, the driving force applied from the partially toothed gear 200 is decelerated, and therefore a decelerated driving force is transmitted to the driven gear 300.

Figure 7A:
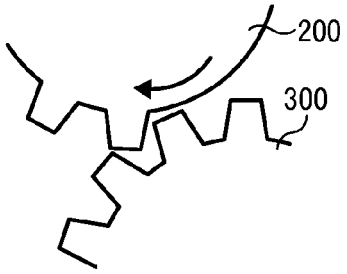
FIG. 7A is a diagram illustrating a state in which the driven gear of FIG. 6 is stopped at a regular stop position.
Figure 7B:
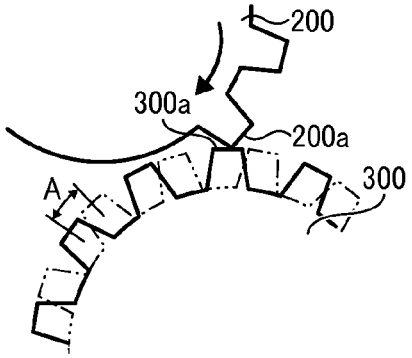
FIG. 7B is a diagram illustrating a state in which the driven gear of FIG. 6 is not stopped at the regular stop position.

In a drive transmitted using the partially toothed gear as described above, when the partially toothed gear and the drive gear are disengaged, rotation of the driven gear 300 usually stops at that moment, as illustrated in FIG. 7A. However, in a case in which the driven gear 300 does not stop at a regular stop position, which is indicated by a two-dot chain line, but stops at a position shifted from the regular stop position by a distance A, respective positions of teeth of the driven gear 300 also shift. In that case, it is likely that a tooth tip 300*a* of the driven gear 300 that is supposed to come after an adjacent preceding tooth tip of the driven gear 300 meshes with a tooth tip 200*a* of the partially toothed gear 200 contacts with the tooth tip 200*a* of the partially toothed gear 200 as illustrated in FIG. 7B. As a result, the contact of the tooth tip 300*a* of the driven gear 300 and the tooth tip 200*a* of the partially toothed gear 200 can cause impact and, in a worst case, damage or break the tooth tip(s).

In order to address the above-described inconvenience, the drive transmitter 150 according to the present example includes a rotation regulator to regulate rotation of the conveying gear 25 so that the partially toothed gear 29 and the conveying gear 25 are meshed correctly. Specifically, the seal 26 illustrated in FIG. 2 functions as a rotation regulator according to the present example.

Figure 8:
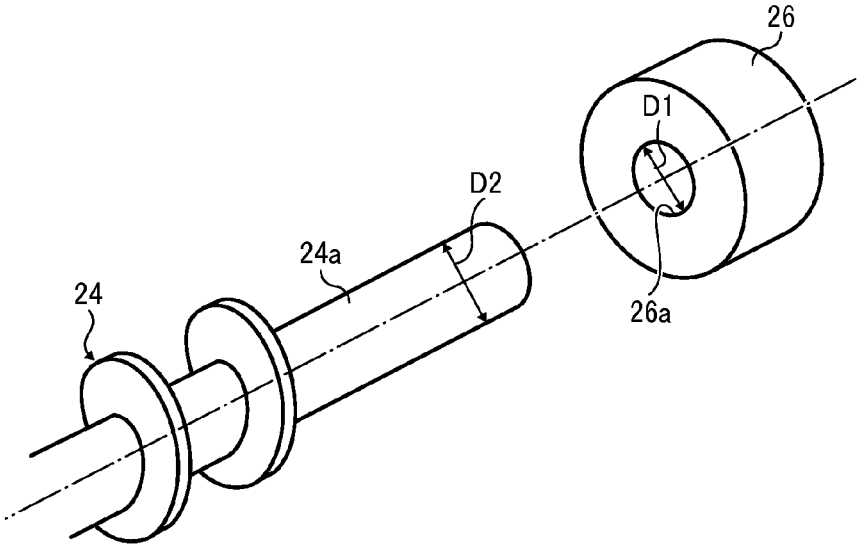
FIG. 8 is a diagram illustrating a structure of a seal.

FIG. 8 is a diagram illustrating a structure of the seal 26.

As illustrated in FIG. 8, the seal 26 is a cyclic (ring-shaped) or cylindrical member having an opening 26*a* at the center thereof so that the rotary shaft 24*a* of the conveying screw 24 is inserted thereinto. An inner diameter D1 of the opening 26*a* is set to be smaller than an outer diameter of the rotary shaft 24*a* of the conveying screw 24 in a state in which the rotary shaft 24*a* of the conveying screw 24 is not inserted. Therefore, when the rotary shaft 24*a* of the conveying screw 24 is inserted into the opening 26*a* of the seal 26, the seal 26 elastically deforms to increase the opening 26*a*. Consequently, an inner circumferential surface of the seal 26 is pressed against an outer circumferential surface of the rotary shaft 24*a* of the conveying screw 24. As a result, the seal 26 is secured to the rotary shaft 24*a* of the conveying screw 24 without rotating with respect to the rotary shaft 24*a*.

Figure 9:
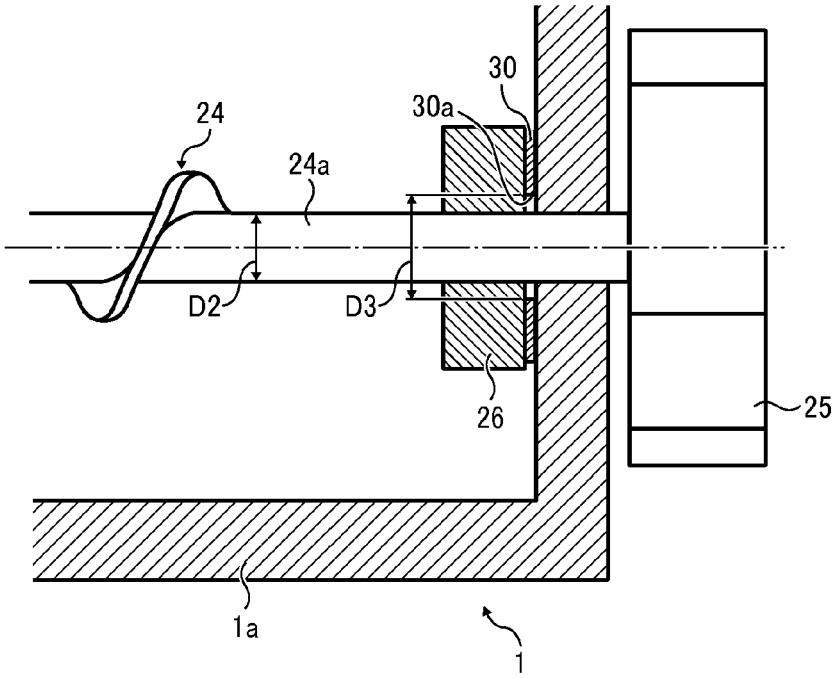
FIG. 9 is a diagram illustrating a structure of a double-sided tape that fixes the seal.

FIG. 9 is a diagram illustrating a structure of a double-sided tape 30 that fixes the seal 26.

As illustrated in FIG. 9, the seal 26 is attached and fixed to the housing 1*a* of the process unit 1 with the double-sided tape 30. The double-sided tape 30 is a cyclic (ring-shaped) member having an opening 30*a* at the center thereof so that the rotary shaft 24*a* of the conveying screw 24 is inserted thereinto. In other words, the seal 26 contacts the rotary shaft 24*a* of the conveying screw 24.

Since the seal 26 is attached and fixed to the housing 1*a* with the double-sided tape 30, as the conveying screw 24 rotates, sliding resistance is generated between the outer circumferential surface of the rotary shaft 24*a* of the conveying screw 24 (in other words, the rotary shaft of the conveying gear 25) and the inner circumferential surface of the seal 26. The sliding resistance applies a rotational load to regulate the number of rotation of the conveying gear 25, so that the conveying gear 25 can stop at the given regular stop position.

It is to be noted that a position to stop the conveying gear 25 using sliding resistance is not limited to the position where the conveying gear 25 is disengaged from the partially toothed gear 29 (the position illustrated in FIG. 4A). Specifically, as long as the subsequent engagement of the partially toothed gear 29 and the conveying gear 25 is performed correctly, the conveying gear 25 can stop at a position shifted slightly from where the conveying gear 25 is disengaged from the partially toothed gear 29.

Figure 10:
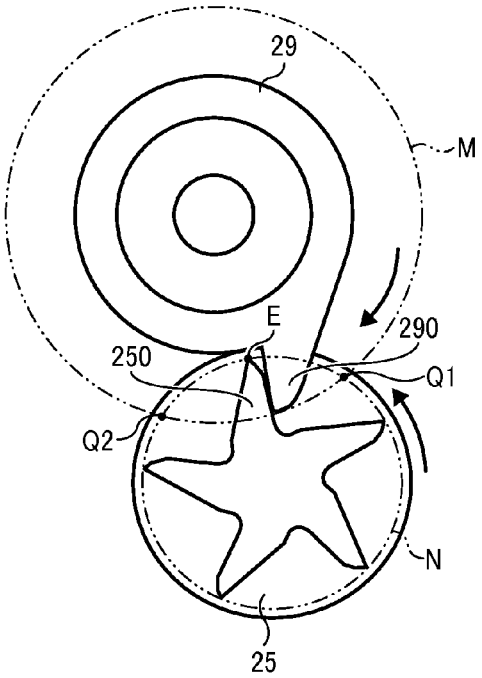
FIG. 10 is a diagram illustrating a tip position of the projection of the conveying gear.

FIG. 10 is a diagram illustrating a tip position E of the projection 250 of the conveying gear 25. A trajectory M of a tip of the projection 290 of the partially toothed gear 29 and a trajectory N of a tip of the projection 250 of the conveying gear 25 intersect with each other at an intersection start point Q1 and an intersection end point Q2.

As illustrated in FIG. 10, the rotation of the conveying gear 25 is regulated such that the tip position E of the projection 250 of the conveying gear 25 that meshes with the projection 290 of the partially toothed gear 29 in the sequential engagement is located downstream from the intersection start point Q1 in the rotation direction of the conveying gear 25 and is located upstream from the intersection end point Q2 in the rotation direction of the conveying gear 25. By regulating the rotation of the conveying gear 25, contact of the tip of the projection 290 and the tip of the projection 250 can be prevented, and therefore the projections 290 and 250 can be meshed with each other reliably. As a result, production of the above-described defect images, unevenness in image density, and damage or break of the projections 290 and 250 can be prevented.

If the rotational load applied by the seal 26 is too small, rotation of the conveying gear 25 cannot be regulated properly. By contrast, if the rotational load is too large, a higher output drive source may need to be provided. Therefore, these rotational loads are not preferable. Further, the rotational load applied by the seal 26 varies depending on an amount of compression of the seal 26 in a radial direction thereof when the seal 26 is attached to the conveying screw 24. Accordingly, the amount of compression of the seal 26 in the radial direction is set to a value that can obtain an appropriate rotational load. It is preferable to set the amount of compression of the seal 26 in the radial direction to about 10% of the outer diameter of the conveying screw 24. For example, when the outer diameter of the rotary shaft 24*a* of the conveying screw 24 is 4 mm, the inner diameter of the seal 26 is set to 3.6 mm so as to obtain 0.4 mm of the amount of compression.

Further, as illustrated in FIG. 9, it is preferable that an inner diameter D3 of the opening 30*a* of the double-sided tape 30 is greater than the outer diameter D2 of the rotary shaft 24*a* of the conveying screw 24. By setting the inner diameter D3 of the opening 30*a* and the outer diameter D2 of the rotary shaft 24*a* of the conveying screw 24 as described above, dispersion of a sliding load on the conveying screw 24 caused by attachment of adhesive material of the double-sided tape 30 to the rotary shaft 24*a* of the conveying screw 24 can be prevented.

Now, a description is given of different configurations of the drive transmitter 150 of the process unit 1 according to other examples of this disclosure. It is to be noted that similar effects can be obtained where units and components in the following configurations are identical to those employed in the configuration according to the above-described examples. Therefore, the description of such units and components are summarized or omitted.

Figure 11A:
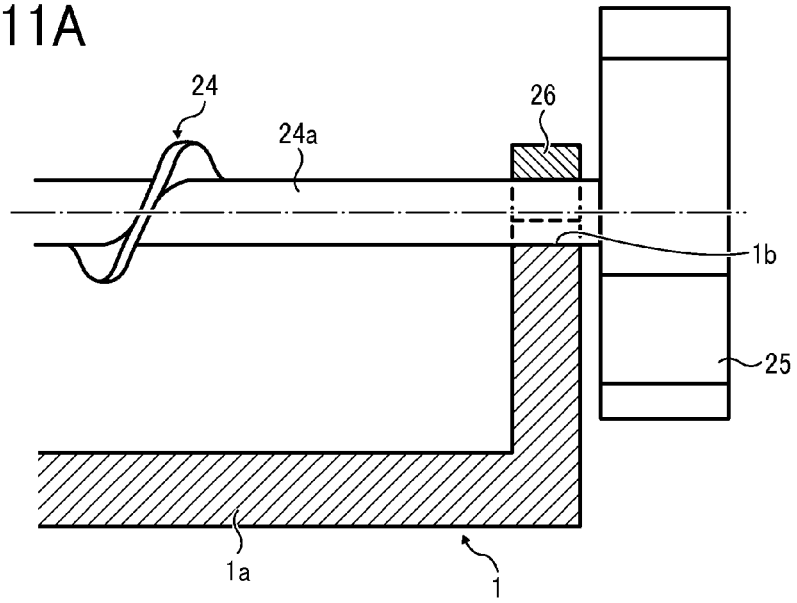
FIG. 11A is a diagram illustrating a configuration of the process unit according to another example of this disclosure, viewed in a direction perpendicular to an axial direction of a conveying screw.
Figure 11B:
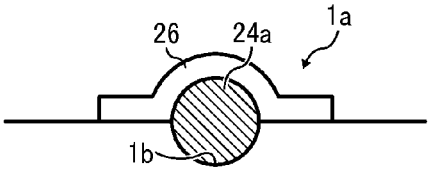
FIG. 11B is a diagram illustrating a configuration of the process unit according to another example of this disclosure, viewed in the axial direction of the conveying screw.

FIG. 11A is a diagram illustrating a configuration of the process unit 1 according to another example of this disclosure, viewed in a direction perpendicular to an axial direction of the conveying screw 24. FIG. 11B is a diagram illustrating the configuration of the process unit 1 of FIG. 11A, viewed in the axial direction of the conveying screw 24.

While the bearing 1*b* of the housing 1*a* that supports the rotary shaft 24*a* of the conveying screw 24 is formed with a circular opening in the above-described examples, the bearing 1*b* of the housing 1*a* is formed with an arc-shaped recess in the present example as illustrated in FIGS. 11A and 11B. By forming the bearing 1*b* with the arc-shaped recess, the rotary shaft 24*a* of the conveying screw 24 can be inserted and attached to the arc-shaped recess bearing 1*b* in a direction intersecting an axial direction of the rotary shaft 24*a* of the conveying screw 24, and therefore the assembly performance of the rotary shaft 24*a* to the bearing 1*b* is enhanced. In addition, in this case, even if the conveying gear 25 is attached to an axial end of the conveying screw 24, the conveying screw 24 can be assembled to the bearing 1*b* with the arc-shaped recess. Consequently, the conveying screw 24 and the conveying gear 25 can be formed integrally and, as a result, this configuration according to the present example can achieve a reduction in mechanical parts and cost of the image forming apparatus 100.

Further, in the present example, in a state in which the rotary shaft 24*a* of the conveying screw 24 is inserted to the bearing 1*b* with the arc-shaped recess, the rotary shaft 24*a* has an exposed part that is exposed from and not covered by the bearing 1*b* having the arc-shaped recess. The seal 26 is pressed to or attached by pressing to the exposed part of the rotary shaft 24*a*. Both end of the seal 26 are attached to the housing 1*a* with the double-sided tape 30. As a result, the seal 26 is secured to the rotary shaft 24*a* of the conveying screw 24 without rotating with respect to the rotary shaft 24*a*. Thus, by pressing and attaching the seal 26 to the rotary shaft 24*a* of the conveying screw 24, the seal 26 regulates rotation of the conveying gear 25 to stop the conveying gear 25 at the regular stop position, as with the above-described examples.

Figure 12:
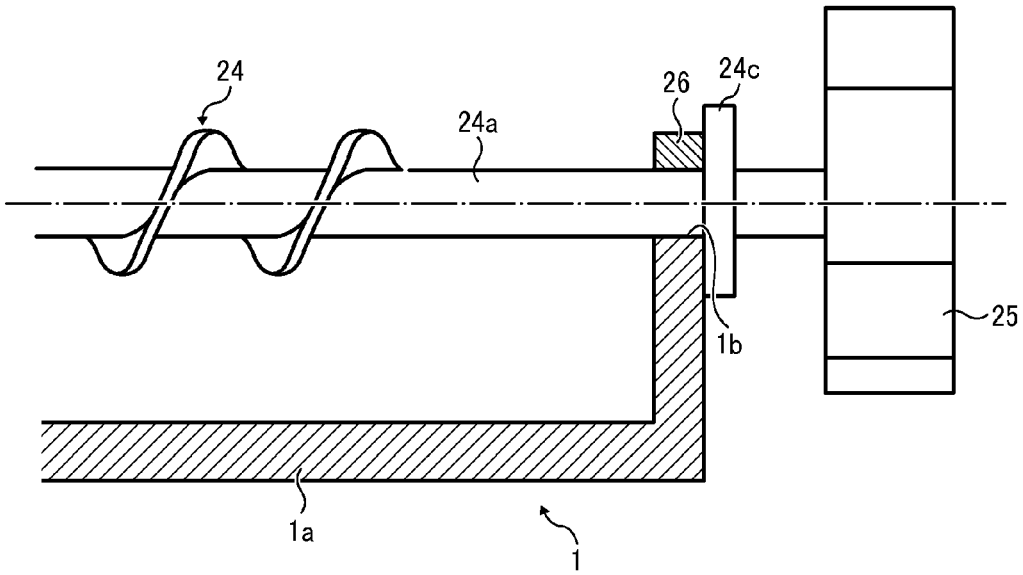
FIG. 12 is a diagram illustrating a configuration of the process unit of FIGS. 11A and 11B, in which a positioning part is provided to one side of a holding part of the conveying screw.
Figure 13:
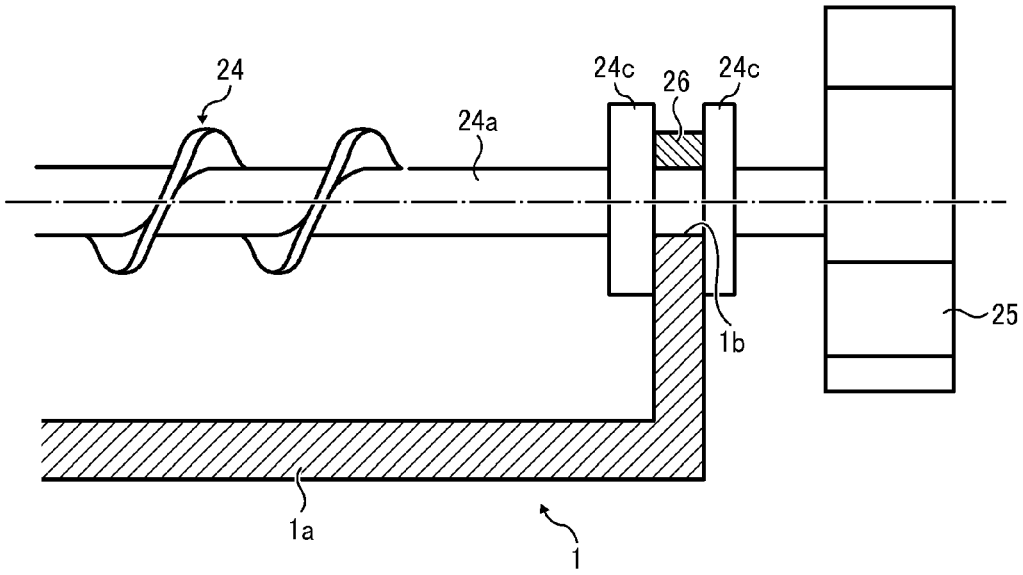
FIG. 13 is a diagram illustrating a configuration of the process unit of FIGS. 9A and 9B, in which the positioning part is provided to both sides of the holding part of the conveying screw.

Further, as described above, the bearing 1*b* formed with the arc-shaped recess can be attached to the rotary shaft 24*a* even if the conveying screw 24 includes a positioning part 24*c* provided to the rotary shaft 24*a* and having an outer diameter that is greater than the inner diameter or width of the bearing 1*b* formed with the arc-shaped recess, as illustrated in FIGS. 12 and 13. FIG. 12 is a diagram illustrating a configuration of the process unit 1 of FIGS. 11A and 11B, in which the positioning part 24*c* is provided to one side of a holding part of the conveying screw 24. FIG. 13 is a diagram illustrating a configuration of the process unit 1 of FIGS. 11A and 11B, in which the positioning parts 24*c* are provided to both sides of the holding part of the conveying screw 24.

As described above, by providing the positioning part(s) 24*c* at one side or both sides of the holding part of the conveying screw 24 held by the arc-shaped recess bearing 1*b*, movement of the conveying screw 24 to one side or both sides thereof in the axial direction can be regulated, and therefore the conveying screw 24 can be positioned reliably.

Figure 14:
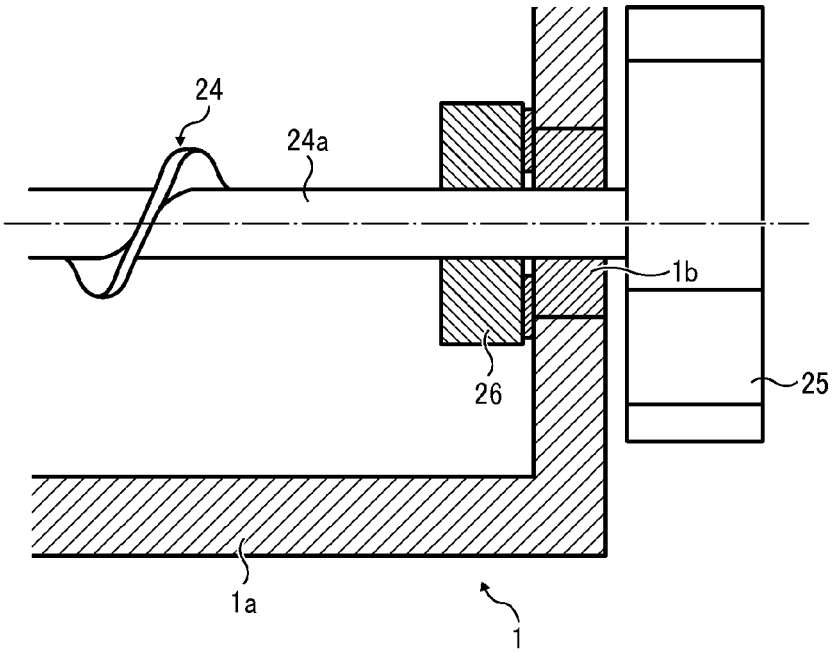
FIG. 14 is a diagram illustrating a configuration of the process unit according to yet another example of this disclosure.

FIG. 14 is a diagram illustrating a configuration of the process unit 1 according to yet another example of this disclosure.

In the present example illustrated in FIG. 14, the bearing 1*b* of the housing 1*a* that supports the rotary shaft 24*a* of the conveying screw 24 is formed of a material having high slidability such as a polyacetal resin.

Generally, the material for forming the housing 1*a* of the process unit 1 is selected by giving priority to securing strength over slidability. In addition, selection of a material having slidability and strength results in an increase in cost. Therefore, the bearing 1*b* (including a surface thereof and the adjacent part) alone includes a material having high slidability, so that high slidability thereof can be secured at a minimum increase in cost. Different appropriate materials can be selected for the other parts of the bearing 1*b*.

In the present example, the bearing 1*b* includes a material having high slidability, and therefore the sliding friction generated between the rotary shaft 24*a* of the conveying screw 24 and the bearing 1*b* is smaller than the sliding friction generated between the rotary shaft 24*a* of the conveying screw 24 and the seal 26. By so doing, the effect by the rotational load that is applied by the seal 26 to the conveying gear 25 is more dominant than the effect by the rotational load that is applied by the bearing 1*b* to the conveying gear 25.

If the bearing 1*b* includes a material having low slidability, as the amount of waste toner around the conveying screw 24 increases, the rotational load caused by friction between the bearing 1*b* and the conveying screw 24 becomes greater. By contrast, the rotational load caused by friction between the seal 26 and the conveying screw 24 remains constant regardless of change of the amount of waste toner around the conveying screw 24.

By making the effect by the rotational load applied by the seal 26 to the conveying gear 25 more dominant than the effect by the rotational load applied by the bearing 1*b* to the conveying gear 25, even if the amount of waste toner changes (increases or decreases), the effect to the rotational load associated with the change of the amount of waste toner can be reduced and, as a result, constant regulation of rotation of the conveying gear 25 can be achieved.

Figure 15:
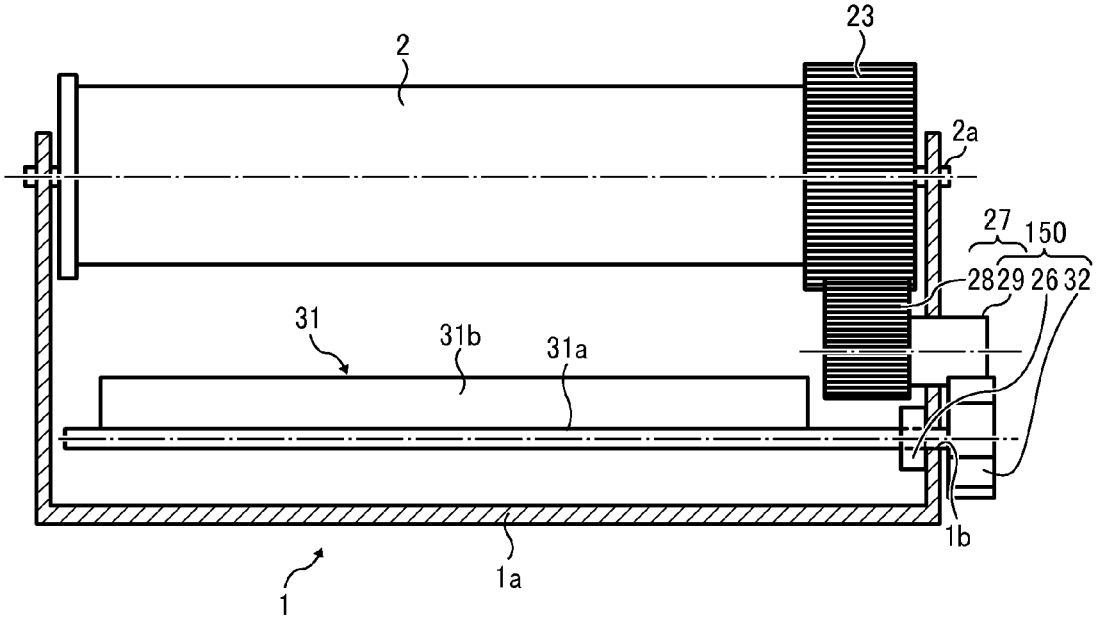
FIG. 15 is a diagram illustrating a configuration of the process unit including a stirring paddle according to another example of this disclosure.

FIG. 15 is a diagram illustrating a configuration of the process unit 1 including a stirring paddle 31 according to another example of this disclosure.

In the configuration of the process unit 1 according to the present example illustrated in FIG. 15, the stirring paddle 31 is provided in the housing 1*a* thereof. The stirring paddle 31 is a stirring member to stir and agitate the waste toner stored therein. The stirring paddle 31 includes a rotary shaft 31*a* and a blade 31*b*. The blade 31*b* is a planar member provided over the outer circumference of the rotary shaft 31*a* along the axial direction thereof. A stirring gear 32 is provided at one axial end of the rotary shaft 31*a* of the stirring paddle 31.

The stirring gear 32 has a similar structure to the conveying gear 25 that is provided to the conveying screw 24. Specifically, a driving force is transmitted to the stirring gear 32 via the partially toothed gear 29, so that the stirring paddle 31 rotates at a reduced speed. Since the driving force is transmitted so that the stirring paddle 31 rotates at the reduced speed, the stirring paddle 31 does not rotate too fast, and therefore deterioration of toner and an increase in temperature in the image forming apparatus 100 caused by fast rotation of the stirring paddle 31 can be prevented.

Further, in the present example, the seal 26 is used to regulate rotation of the stirring gear 32 such that the partially toothed gear 29 and the stirring gear 32 are meshed properly, and therefore the stirring gear 32 stops at a regular stop position, which is depicted in FIG. 10. Consequently, contact of the tip of the projection 290 of the partially toothed gear 29 and a tip of a projection of the stirring gear 32 can be prevented, and therefore the partially toothed gear 29 and the stirring gear 32 can be meshed with each other reliably. As a result, production of defect images, unevenness in image density, and damage or break of the projections can be prevented.

Further, FIG. 15 shows a configuration in which the blade 31*b* of the stirring paddle 31 is not disposed at a line-symmetrical position with respect to the rotary shaft 31*a*. In this case, the stirring paddle 31 is rotated by a rotational moment developed due to the self-weight thereof more easily than the above-described conveying screw 24, and therefore it is difficult for the stirring paddle 31 to stop at the regular stop position. For this reason, a rotation regulator according to the present example of this disclosure is preferably and effectively applied to the stirring paddle 31 having the above-described structure. In this case, the rotational load applied by the rotation regulator is set to be greater than the rotational moment developed due to the self-weight of the stirring paddle 31.

In the above-described examples of this disclosure, the seal 26 is employed as a rotational load applier (i.e., a rotation regulator) to apply a rotational load to the conveying gear 25 and the stirring gear 32. However, a configuration including a different rotational load applier to apply a rotational load different from the seal 26 can also be applied. Alternatively, the bearing 1*b* that supports the conveying screw 24 as illustrated in FIGS. 11A through 14 and the bearing 1*b* that supports the stirring paddle 31 as illustrated in FIG. 15 can also be employed as a rotational load applier.

Figure 16:
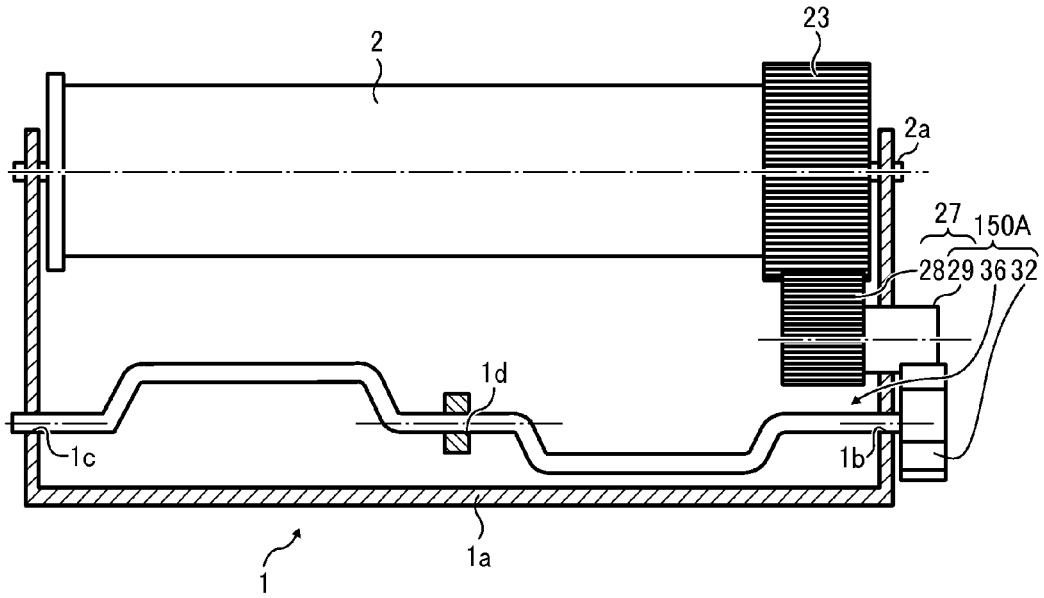
FIG. 16 is a diagram illustrating a configuration of the process unit including a stirring paddle according to yet another example of this disclosure.

For example, FIG. 16 is a diagram illustrating a configuration of the process unit 1 including a stirring paddle 36 according to yet another example of this disclosure. In the configuration illustrated in FIG. 16, the partially toothed gear 29, the stirring gear 32, and the stirring paddle 36 form a drive transmitter 150A.

As illustrated in FIG. 16, the process unit 1 includes the stirring paddle 36 that is bent and inclined at angles in alternate directions bordering a middle part in a longitudinal direction of the stirring paddle 36. The stirring paddle 36 is rotatably supported by the bearing 1*b* and a bearing 1*c* at both axial ends and a bearing 1*d* at the middle part in the axial direction thereof. By providing the bearings 1*b*, 1*c*, and 1*d*, a center line position of each opening of the bearings 1*b*, 1*c*, and 1*d* through which the stirring paddle 36 is shifted in a radial direction of the stirring paddle 36. With this configuration, the stirring paddle 36 is pressed against an inner circumferential surface of each of the bearings 1*b*, 1*c*, and 1*d*. Consequently, the sliding resistance between each of the bearings 1*b*, 1*c*, and 1*d* and the stirring paddle 36 is increased and, as a result, rotation of the stirring gear 32 can be regulated. As another method to increase the sliding resistance between a bearing (e.g., the bearings 1*b*, 1*c*, 1*d*) and a stirring paddle (e.g., the stirring paddle 31 and 36) or a conveying screw (e.g., the conveying screw 24), the bearing is formed of a material having high sliding resistance such as a rubber material or the inner circumferential surface of the bearing is processed to have a rough surface. If the sliding resistance is increased, the effect by the rotational load applied by the bearing may be dominant. However, as long as there is any problems or inconvenience with the effect by the rotational load along with change of the amount of waste toner, this method can be employed.

It is to be noted that this disclosure is not limited to the above-described examples. For example, the drive transmitter 150 according to this disclosure can be applied to a process unit that includes both a stirring paddle and a conveying screw. In this case, a gear that is linked and connected to a photoconductor gear via a partially toothed gear can be any one or both of the stirring gear and the conveying gear.

In the above-described examples, the photoconductor gear 23 and the conveying gear 25 or the stirring gear 32 are connected via the connection gear 27 having the partially toothed gear 29. However, another gear can be disposed between the connection gear 27 and the photoconductor gear 23. In addition, yet another gear can be disposed between the connection gear 27 and the conveying gear 25 or between the connection gear 27 and the stirring gear 32. In other words, the number or position of gears forming a gear train to transmit a driving force between the photoconductor 2 and the conveying screw 24 or between the photoconductor 2 and the stirring paddle 31 can be changed optionally. In summary, in the gear train that transmits a driving force between the photoconductor 2 and the conveying screw 24 or between the photoconductor 2 and the stirring paddle 31, this disclosure can be widely applied to the drive transmitter 150 that includes a first gear corresponding to the partially toothed gear 29 disposed on the side of the photoconductor 2 and a second gear corresponding to the conveying gear 25 or the stirring gear 32 disposed on the side of the conveying screw 24 or the stirring paddle 31 and can be meshed with the first gear.

Further, the drive transmitter 150 according to this disclosure is not limited to a drive transmitter to transmit a driving force to a conveying screw that conveys waste toner or to a rotator such as a stirring paddle that stirs the waste toner, as described above. For example, FIG. 17 is a diagram illustrating a configuration of a toner cartridge 33 including a conveying screw 34 and a stirring paddle 35.

Figure 17:
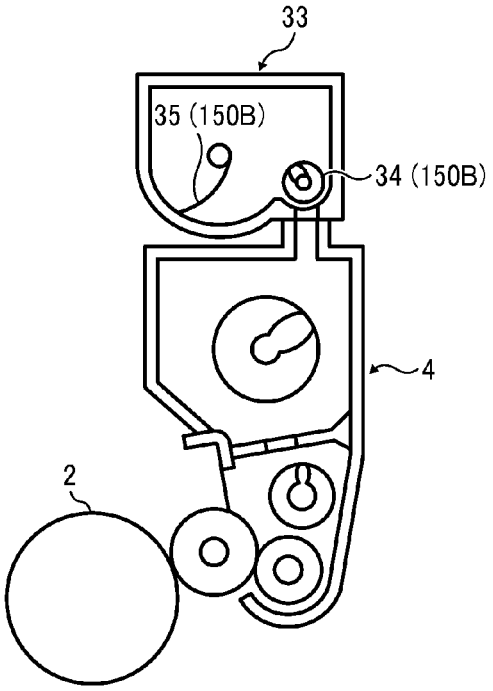
FIG. 17 is a diagram illustrating a configuration of a toner cartridge including a conveying screw and a stirring paddle.

As illustrated in FIG. 17, this disclosure can be applied to a drive transmitter 150B that transmits a driving force to a rotor (e.g., the conveying screw 34 or the stirring paddle 35) to convey or stir toner contained in the toner cartridge 33. It is to be noted that the drive transmitter 150B may be the conveying screw 34 or the stirring paddle 35.

In the toner cartridge 33 that stores the toner to be supplied to an image formed on a photoconductor, as the toner is running out, the rotational load on the conveying screw 34 or the stirring paddle 35 decreases. Consequently, it is not likely that a gear used to transmit the driving force to the rotor stops at a regular stop position. Therefore, this disclosure can be applied to the drive transmitter 150B in which the driving force is transmitted to the conveying screw 34 or the stirring paddle 35, so that gears to transmit the driving force to the conveying screw 34 or the stirring paddle 35 can be meshed reliably.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A drive transmitter comprising:

a first gear having at least one tooth on an outer circumference thereof, the first gear being rotated by a drive source;

a second gear having multiple teeth on an outer circumference thereof, one of the multiple teeth of the second gear configured to mesh with the at least one tooth of the first gear and rotate with the first gear, the first gear configured to continuously rotate and the second gear configured to remain stationary in a state in which the first gear and the second gear are not meshed, the first gear configured to transmit a driving force transmitted by the drive source to the second gear in a state in which the number of rotations of the second gear per unit time is smaller than the number of rotations of the first gear, wherein a trajectory of a tip of the at least one tooth of the first gear and a trajectory of a tip of the one of the multiple teeth of the second gear are configured to intersect with each other at an intersection start point and an intersection end point; and a rotation regulator configured to regulate rotation of the second gear such that a position of the tip of the one of the multiple teeth of the second gear meshing with the at least one tooth of the first gear is downstream from the intersection start point in a rotation direction of the second gear and is upstream from the intersection end point in the rotation direction of the second gear.

2. The drive transmitter according to claim 1, wherein the rotation regulator is a rotational load applier to apply a rotational load to the second gear.

3. The drive transmitter according to claim 2, wherein the rotational load applier contacts a rotary shaft of the second gear.

4. The drive transmitter according to claim 3, further comprising a gear train including the first gear and the second gear, the gear train configured to transmit the driving force between a latent image bearer to bear a latent image on a surface thereof and a rotator to either convey or stir powder used for image formation to the latent image, wherein the first gear is on a side of the latent image bearer, wherein the second gear is on a side of the rotator.

5. The drive transmitter according to claim 4, wherein the rotator includes a rotary shaft that is rotatably supported by a bearing, wherein the second gear is mounted on one axial end of the rotary shaft of the rotator, wherein the rotational load applier includes a seal configured to prevent powder from coming in between the rotary shaft of the rotator and the bearing.

6. The drive transmitter according to claim 5, wherein the seal is a urethane foam having an apparent density of 58 kg/m$^3$ or greater.

7. The drive transmitter according to claim 5, wherein the seal includes an elastic member with an opening having an inner diameter smaller than an outer diameter of the rotary shaft of the rotator, wherein, when the rotary shaft of the rotator is inserted into the opening of the seal, the seal is secured to the rotary shaft without rotating with respect to the rotary shaft.

8. The drive transmitter according to claim 5, wherein the bearing includes a recess to which the rotary shaft of the rotator is configured to be inserted in a direction intersecting an axial direction of the rotary shaft, wherein, in a state in which the rotary shaft of the rotator is inserted in to the recess, the seal is pressed against an exposed part of the rotary shaft exposed from the recess and the seal is secured to the rotary shaft without rotating with respect to the rotary shaft.

9. The drive transmitter according to claim 5, wherein a sliding friction between the rotary shaft of the rotator and the bearing is smaller than a sliding friction between the rotary shaft of the rotator and the rotational load applier.

10. A process unit comprising, a latent image bearer configured to bear a latent image on a surface thereof;

a rotator configured to either convey or stir powder used for image formation to the latent image; and the drive transmitter according to claim 3 further including a gear train including the first gear and the second gear and configured to transmit the driving force applied from the drive source to the latent image bearer and the rotator, wherein the first gear is on a side of the latent image bearer, wherein the second gear is on a side of the rotator.

11. An image forming apparatus comprising the drive transmitter according to claim 1.

12. A gear of a drive transmitter of an image forming apparatus, the gear comprising:

a plurality of gear teeth configured to mesh with a transmitting gear of the image forming apparatus, each of the plurality of gear teeth including:

a first surface extending from a core of the gear substantially parallel to a long axis of the tooth between a rotational center of the gear and a tip of the tooth, and a second surface opposite to the first surface, and inclined with respect to the long axis of the tooth such that a bottom of the tooth nearer to the core of the gear is wider than the tip of the tooth, wherein the first surface includes an inclined surface at the tip inclined with respect to the long axis of the tooth and inclined in an opposite direction of the second surface.

13. The gear according to claim 12, wherein the first surface of each of the plurality of gear teeth is configured to contact a tooth of the transmitting gear when a drive force is transmitted.

14. The gear according to claim 12, wherein the inclined surface is inclined toward the tip of the tooth.

15. The gear according to claim 12, wherein the gear has a substantially star shape.

16. The gear according to claim 15, wherein the plurality of gear teeth includes five teeth.

17. The gear according to claim 12, wherein a trajectory of the tip of each of the plurality of gear teeth follows a trajectory of a tooth bottom of the transmitting gear.

18. A gear of a drive transmitter of an image forming apparatus, the gear comprising:

a plurality of gear teeth configured to mesh with a transmitting gear of the image forming apparatus, each of the plurality of gear teeth including a first surface and an inclined surface on a smaller of a first asymmetrical side of the tooth and a second surface on a larger of a second asymmetrical side of the tooth, where the first and second asymmetrical sides of the tooth are asymmetrical with respect to a long axis of the tooth from a rotational center of the gear to a tip of the tooth.

19. The gear according to claim 18, wherein the first surface of each of the plurality of gear teeth is configured to contact a tooth of the transmitting gear when a drive force is transmitted.

20. The gear according to claim 18, wherein the inclined surface is inclined toward a tip of the tooth.

21. The gear according to claim 18, wherein the gear has a substantially star shape.

22. The gear according to claim 21, wherein the plurality of gear teeth includes five teeth.

23. The gear according to claim 18, wherein a trajectory of a tip of the tooth of each of the plurality of gear teeth follows a trajectory of the a tooth bottom of the transmitting gear.

* * * * *